US011473159B2

(12) United States Patent
Hirashima et al.

(10) Patent No.: US 11,473,159 B2
(45) **Date of Patent: *Oct. 18, 2022**

(54) HOT ROLLED STEEL SHEET AND METHOD FOR PRODUCING SAME

(71) Applicant: NIPPON STEEL CORPORATION, Tokyo (JP)

(72) Inventors: Tetsuya Hirashima, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 157 days.

This patent is subject to a terminal disclaimer.

(21) Appl. No.: 16/754,081

(22) PCT Filed: Nov. 22, 2018

(86) PCT No.: PCT/JP2018/043272

§ 371 (c)(1),
(2) Date: Jul. 29, 2020

(87) PCT Pub. No.: WO2019/103120

PCT Pub. Date: May 31, 2019

(65) Prior Publication Data

US 2020/0362428 A1 Nov. 19, 2020

(30) Foreign Application Priority Data

Nov. 24, 2017 (JP) ..... JP2017-225676

(51) Int. Cl.

| | |
|---|---|
| ***B32B 15/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/002* (2013.01); *C21D 2211/005* (2013.01)

(58) Field of Classification Search

None

See application file for complete search history.

(56) References Cited

U.S. PATENT DOCUMENTS

| | | | | |
|---|---|---|---|---|
| 8,460,481 | B2 * | 6/2013 | Azuma | C21D 8/0273 148/320 |
| 2014/0000765 | A1 | 1/2014 | Nozaki | |
| 2016/0017465 | A1 | 1/2016 | Toda et al. | |
| 2018/0023155 | A1 | 1/2018 | Takeda et al. | |

FOREIGN PATENT DOCUMENTS

| | | | |
|---|---|---|---|
| EP | 3715492 | A1 | 9/2020 |
| JP | 61-159528 | A | 7/1986 |
| JP | 61-170518 | A | 8/1986 |
| JP | 2000-290748 | A | 10/2000 |
| JP | 2000-290750 | A | 10/2000 |
| JP | 2000290756 | A * | 10/2000 |
| JP | 3242303 | B2 | 12/2001 |
| JP | 4006112 | B2 | 11/2007 |
| JP | 2011-58022 | A | 3/2011 |
| TW | 201502286 | A | 1/2015 |
| WO | WO 2014/171427 | A1 | 10/2014 |
| WO | WO 2016/136810 | A1 | 9/2016 |

OTHER PUBLICATIONS

International Search Report (form PCT/ISA/210), dated Jan. 15, 2019 for International Application No. PCT/JP2018/043272, with an English translation.

Taiwanese Office Action and Search Report, dated Mar. 10, 2020, for Taiwanese Application No. 107141919.

Written Opinion of the International Searching Authority (form PCT/ISA/237), dated Jan. 15, 2019 for International Application No. PCT/JP2018/043272, with an English translation.

* cited by examiner

*Primary Examiner* — Seth Dumbris

(74) *Attorney, Agent, or Firm* — Birch, Stewart, Kolasch & Birch, LLP

(57) ABSTRACT

Provided is a hot rolled steel sheet comprising a predetermined composition wherein the hot rolled steel sheet comprises first ferrite with an average orientation difference in the same grain of 0.5 to 5.0° in 30 to 70 vol %, at least one type of structures among bainite and second ferrite with an average orientation difference of 0 to less than 0.5° and the first ferrite in a total of 95 vol % or more, a balance microstructure of 5 vol % or less, has an average grain size of the first ferrite of 0.5 to 5.0 μm, and has an average grain size of the other structures of 1.0 to 10 μm. Provided is a method for producing a hot rolled steel sheet comprising rolling where two or more consecutive passes of rolling including a final pass are performed under conditions of a rolling temperature: A point or more and less than $Ae_3$ point etc., and where a total strain amount of all passes satisfying the conditions is 1.4 to 4.0, cooling by a 20 to 50° C./sec average cooling rate, and coiling the steel sheet at 300° C. to 600° C.

4 Claims, 2 Drawing Sheets

FIG. 1

Table 2-1

| No. | Steel type | Hot rolling | | | | | | | | | | | | | | | | | |
|---|---|---|---|---|---|---|---|---|---|---|---|---|---|---|---|---|---|---|---|
| | | Heating temp. | Total strain amount | F1 | | | | F2 | | | | F3 | | | | F4 | | | |
| | | | | Rolling temp. | Strain amount | Strain rate | Time between passes | Rolling temp. | Strain amount | Strain rate | Time between passes | Rolling temp. | Strain amount | Strain rate | Time between passes | Rolling temp. | Strain amount | Strain rate | Time between passes |
| | | °C | | °C | | /s | s | °C | | /s | s | °C | | /s | s | °C | | /s | s |
| 1 | A | Direct | 1.87 | 1015 | 0.1 | 0.2 | 3.3 | 952 | 0.18 | 1 | 3 | 927 | 0.13 | 2 | 2.6 | 893 | 0.42 | 4 | 1.9 |
| 2 | A | Direct | 1.87 | 976 | 0.39 | 3 | 5.9 | 939 | 0.45 | 6 | 5.4 | 898 | 0.17 | 10 | 4.3 | 867 | 0.7 | 16 | 3.1 |
| 3 | A | Direct | 2.51 | 930 | 0.39 | 0.6 | 5.9 | 870 | 0.17 | 1 | 5.2 | 855 | 0.44 | 2 | 4.8 | 841 | 0.45 | 4 | 4.4 |
| 4 | A | 1200 | - | 1049 | 0.46 | 3 | 6.8 | 1014 | 0.3 | 5 | 6.7 | 978 | 0.17 | 11 | 6.4 | 951 | 0.27 | 20 | 5.5 |
| 5 | A | 1250 | 1.6 | 997 | 0.49 | 1 | 4.4 | 955 | 0.21 | 2 | 4 | 923 | 0.22 | 5 | 3.3 | 886 | 0.27 | 9 | 2.9 |
| 6 | B | Direct | 2.07 | 1035 | 0.28 | 1 | 4.4 | 988 | 0.1 | 2 | 3.8 | 938 | 0.22 | 4 | 2.7 | 866 | 0.21 | 10 | 1.8 |
| 7 | B | Direct | 1.8 | 974 | 0.15 | 0.6 | 6.5 | 944 | 0.28 | 1 | 6.3 | 877 | 0.13 | 4 | 5.7 | 830 | 0.35 | 6 | 4.2 |
| 8 | B | Direct | 2.2 | 963 | 0.32 | 1 | 6.2 | 913 | 0.31 | 2 | 5.7 | 874 | 0.46 | 5 | 4.3 | 847 | 0.62 | 8 | 3.1 |
| 9 | B | 1150 | 2 | 903 | 0.32 | 3 | 4.5 | 854 | 0.43 | 7 | 4 | 829 | 0.22 | 10 | 3.6 | 811 | 0.56 | 15 | 3.3 |
| 10 | B | 1200 | 2.24 | 1038 | 0.28 | 4 | 4.8 | 876 | 0.39 | 10 | 3.8 | 831 | 0.45 | 14 | 2.3 | 819 | 0.65 | 20 | 2 |
| 11 | C | Direct | 1.43 | 1016 | 0.4 | 1 | 4.8 | 986 | 0.25 | 2 | 3.8 | 945 | 0.15 | 4 | 3.5 | 904 | 0.17 | 7 | 3.4 |
| 12 | C | Direct | 2.49 | 943 | 0.2 | 4 | 4.9 | 900 | 0.23 | 10 | 4.6 | 869 | 0.46 | 15 | 3.6 | 845 | 0.54 | 18 | 2.7 |
| 13 | C | Direct | 1.52 | 964 | 0.24 | 3 | 4.9 | 912 | 0.47 | 6 | 4.3 | 888 | 0.19 | 13 | 4 | 850 | 0.29 | 21 | 3.1 |
| 14 | C | 1250 | 1.48 | 991 | 0.16 | 0.4 | 6.7 | 954 | 0.26 | 1 | 5.9 | 913 | 0.21 | 2 | 5.6 | 887 | 0.43 | 4 | 4.5 |
| 15 | C | 1300 | 3.07 | 964 | 0.19 | 0.4 | 4.8 | 928 | 0.34 | 0.8 | 4.2 | 849 | 0.49 | 7 | 2 | 822 | 0.57 | 10 | 1.9 |
| 16 | D | Direct | - | 904 | 0.41 | 1 | 5 | 841 | 0.36 | 2 | 4.8 | 806 | 0.47 | 5 | 4 | 772 | 0.54 | 7 | 3 |
| 17 | D | Direct | 1.49 | 972 | 0.16 | 0.9 | 6.2 | 929 | 0.35 | 2 | 6 | 899 | 0.36 | 4 | 5.1 | 869 | 0.22 | 6 | 4 |
| 18 | D | Direct | 1.98 | 954 | 0.45 | 6 | 5.6 | 917 | 0.18 | 14 | 4.6 | 873 | 0.14 | 16 | 4.1 | 859 | 0.55 | 22 | 3.8 |
| 19 | E | 1200 | 1.83 | 978 | 0.11 | 0.7 | 5.8 | 933 | 0.49 | 1 | 5.4 | 898 | 0.48 | 4 | 4.2 | 854 | 0.68 | 6 | 3.9 |
| 20 | E | 1200 | 1.44 | 1008 | 0.49 | 6 | 4.9 | 974 | 0.33 | 14 | 4.7 | 930 | 0.21 | 20 | 3.7 | 885 | 0.69 | 26 | 3 |
| 21 | E | Direct | 1.6 | 974 | 0.49 | 1 | 6.4 | 943 | 0.18 | 3 | 6.3 | 908 | 0.22 | 7 | 5.1 | 854 | 0.48 | 12 | 4.7 |
| 22 | F | Direct | 1.69 | 1007 | 0.45 | 3 | 5 | 976 | 0.23 | 6 | 4.7 | 933 | 0.26 | 10 | 4.5 | 871 | 0.27 | 16 | 3.5 |
| 23 | F | 1250 | 1.55 | 960 | 0.12 | 0.5 | 5.4 | 917 | 0.42 | 1 | 4.7 | 882 | 0.44 | 2 | 4.2 | 850 | 0.42 | 3 | 3.7 |
| 24 | F | 1150 | 1.66 | 968 | 0.42 | 3 | 4.4 | 927 | 0.27 | 5 | 3.9 | 889 | 0.22 | 6 | 2.4 | 855 | 0.55 | 9 | 2 |
| 25 | G | Direct | 1.43 | 998 | 0.32 | 0.5 | 5.6 | 949 | 0.17 | 0.8 | 4.7 | 901 | 0.5 | 1 | 4 | 866 | 0.53 | 4 | 3.8 |
| 26 | G | Direct | 2.15 | 964 | 0.33 | 3 | 8.3 | 909 | 0.46 | 8 | 7.6 | 879 | 0.23 | 11 | 6.5 | 844 | 0.47 | 18 | 5.9 |
| 27 | G | 1300 | 1.89 | 1000 | 0.36 | 10 | 5.1 | 952 | 0.24 | 15 | 4.4 | 903 | 0.5 | 24 | 3.4 | 854 | 0.48 | 28 | 2.5 |
| 28 | G | 1200 | **0.96** | 1022 | 0.4 | 0.9 | 6.1 | 985 | 0.47 | 2 | 5.7 | 942 | 0.37 | 4 | 5.5 | 897 | 0.43 | 7 | 4.8 |
| 29 | H | Direct | 1.43 | 952 | 0.19 | 0.4 | 5.6 | 918 | 0.13 | 2 | 4.7 | 883 | 0.44 | 4 | 4.5 | 847 | 0.61 | 7 | 3.7 |
| 30 | I | 1250 | 1.43 | 937 | 0.37 | 6 | 4.2 | 887 | 0.34 | 10 | 3.9 | 849 | 0.46 | 16 | 3.7 | 803 | 0.15 | 23 | 3.1 |

Bold underlines show outside scope of present invention.

Cells within bold borders in table show ranges where two or more consecutive passes of rolling including a final pass of finishing rolling respectively satisfy the conditions of rolling temperature: A point or more and less than Ae3 point, strain rate: 1.0 to 50/sec, and time between passes: within 10 seconds.

FIG. 2

Table 2-2

| No. | Steel type | Hot rolling | | | | | | | | | | | Cooling | | Coiling |
|---|---|---|---|---|---|---|---|---|---|---|---|---|---|---|---|
| | | F5 | | | | F6 | | | | F7 | | | | | |
| | | Rolling temp. °C | Strain amount | Strain rate /s | Time between passes s | Rolling temp. °C | Strain amount | Strain rate /s | Time between passes s | Rolling temp. °C | Strain amount | Strain rate /s | T s | Cooling rate °C/s | Coiling temp. °C |
| 1 | A | 861 | 0.57 | 8 | 1.7 | 844 | 0.64 | 10 | 1.2 | 829 | 0.66 | 17 | 1 | 41 | 517 |
| 2 | A | 849 | 0.2 | 23 | 2.2 | 821 | 0.53 | 31 | 1.5 | 805 | 0.44 | 35 | 2 | 31 | 369 |
| 3 | A | 822 | 0.7 | 7 | 3.1 | 804 | 0.51 | 15 | 2.2 | 798 | 0.24 | 23 | 2 | 49 | 323 |
| 4 | A | 933 | 0.3 | 25 | 4.1 | **920** | 0.34 | 29 | 3 | **907** | 0.61 | 33 | 2 | 28 | 380 |
| 5 | A | 854 | 0.45 | 11 | 1.8 | 833 | 0.49 | 19 | 1.7 | 814 | 0.66 | 29 | 2 | **5** | 414 |
| 6 | B | 831 | 0.69 | 11 | 1.1 | 811 | 0.67 | 16 | 0.7 | 803 | 0.71 | 22 | 8 | 30 | 544 |
| 7 | B | 814 | 0.56 | 9 | 3.5 | 799 | 0.25 | 15 | 2.7 | 784 | 0.64 | 20 | 3 | 29 | 444 |
| 8 | B | 814 | 0.62 | 11 | 2.4 | 803 | 0.42 | 16 | 1.6 | 798 | 0.54 | 26 | 3 | 25 | 587 |
| 9 | B | 799 | 0.46 | 17 | 2.6 | 786 | 0.13 | 22 | 1.3 | 774 | 0.63 | 32 | 2 | 49 | 409 |
| 10 | B | 807 | 0.28 | 22 | 1.6 | 789 | 0.5 | 27 | 0.6 | 770 | 0.36 | 33 | 1 | 47 | **213** |
| 11 | C | 873 | 0.69 | 10 | 3.3 | 831 | 0.72 | 17 | 2.7 | 829 | 0.71 | 24 | 9 | 50 | 383 |
| 12 | C | 833 | 0.63 | 20 | 1.7 | 817 | 0.64 | 24 | 0.6 | 808 | 0.68 | 25 | 1 | 50 | 339 |
| 13 | C | 837 | 0.42 | 25 | 1.1 | 801 | 0.4 | 31 | 0.8 | 830 | 0.41 | 43 | **13** | 42 | 328 |
| 14 | C | 833 | 0.45 | 6 | 3.1 | 801 | 0.5 | 11 | 2.8 | 783 | 0.53 | 18 | 3 | 26 | 435 |
| 15 | C | 801 | 0.61 | 15 | 1.1 | 787 | 0.67 | 24 | 1.4 | 769 | 0.73 | 46 | 2 | 40 | 414 |
| 16 | D | 731 | 0.39 | 8 | 1.6 | **703** | 0.22 | 11 | 0.2 | **681** | 0.33 | 18 | 2 | 44 | 477 |
| 17 | D | 854 | 0.54 | 8 | 2.6 | 844 | 0.36 | 11 | 1.6 | 823 | 0.59 | 17 | 1 | 30 | 573 |
| 18 | D | 849 | 0.6 | 23 | 2.8 | 834 | 0.6 | 29 | 2.7 | 817 | 0.23 | 37 | 4 | 33 | 503 |
| 19 | E | 813 | 0.53 | 7 | 2.7 | 802 | 0.66 | 14 | 2.3 | 787 | 0.64 | 19 | 3 | 37 | 393 |
| 20 | E | 846 | 0.36 | 30 | 2.4 | 803 | 0.69 | 34 | 1.6 | 779 | 0.75 | 38 | 2 | 35 | 518 |
| 21 | E | 804 | 0.41 | 14 | 3.2 | 798 | 0.49 | 22 | 2.4 | 774 | 0.7 | 24 | 1 | 33 | 561 |
| 22 | F | 844 | 0.49 | 18 | 3.4 | 830 | 0.56 | 26 | 3 | 805 | 0.64 | 28 | 5 | 41 | 351 |
| 23 | F | 843 | 0.13 | 6 | 2.9 | 811 | 0.47 | 14 | 2.5 | 788 | 0.53 | 21 | 4 | 30 | **648** |
| 24 | F | 841 | 0.56 | 11 | 1.5 | 817 | 0.21 | 19 | 0.4 | 799 | 0.34 | 29 | 3 | 37 | 577 |
| 25 | G | 837 | 0.66 | 5 | 3.3 | 819 | 0.35 | 8 | 2.1 | 800 | 0.42 | 15 | 7 | 21 | 542 |
| 26 | G | 833 | 0.5 | 20 | 4.4 | 814 | 0.52 | 27 | 2.9 | 798 | 0.66 | 30 | 3 | 30 | 590 |
| 27 | G | 829 | 0.53 | 33 | 1.3 | 800 | 0.64 | 36 | 0.1 | 785 | 0.72 | 38 | 5 | 30 | 446 |
| 28 | G | 860 | 0.1 | 8 | 3.7 | 819 | 0.32 | 15 | 2.2 | 803 | 0.64 | 25 | 1 | 23 | 573 |
| 29 | H | 810 | 0.61 | 9 | 3.2 | 782 | 0.43 | 13 | 2.9 | 764 | 0.39 | 19 | 4 | 28 | 306 |
| 30 | I | 784 | 0.15 | 28 | 2.9 | 779 | 0.6 | 32 | 2.5 | 764 | 0.53 | 35 | 2 | 31 | 410 |

Bold underlines show outside scope of present invention.

Cells within bold borders in table show ranges where two or more consecutive passes of rolling including a final pass of finishing rolling respectively satisfy the conditions of rolling temperature: A point or more and less than Ae3 point, strain rate: 1.0 to 50/sec, and time between passes: within 10 seconds.

HOT ROLLED STEEL SHEET AND METHOD FOR PRODUCING SAME

FIELD

The present invention relates to a tensile strength 440 MPa or more hot rolled steel sheet excellent in stretch flangeability and shape freezability suitable as a material for the structural parts or frames or wheel discs of automobiles and to a method for producing the same.

BACKGROUND

As means for improving the mechanical properties of steel material for automobile use, it is known to be effective to refine the grains in the microstructure of that steel material. Refinement of the grains has been taken up in numerous research and development efforts.

For example, PTL 1 proposes production of high tensile hot rolled steel sheet having ultrafine grains and excellent in toughness, fatigue characteristics, and strength-ductility balance obtained by heating a slab containing, by wt %, C: 0.05 to 0.30%, Si: 0.30 to 2.0%, Mn: 1.0 to 2.5%, Al: 0.003 to less than 0.100%, and Ti: 0.05 to 0.30% and having a balance of Fe and unavoidable impurities to 950° C. or more and 1100° C. or less in temperature, then hot rolling it at least two times to give a rolling reduction per pass of 20% or more so that the finishing rolling temperature becomes the $Ar_3$ transformation point or more, then cooling it by a 20° C./sec or more cooling rate and coiling it at a 350° C. to 550° C. temperature range to give a microstructure comprised of polygonal ferrite with an average grain size of less than 10 μm in a volume rate of 75% or more and volume rate of residual austenite of 5 to 20% in the microstructure.

Further, PTL 2 proposes hot rolled steel sheet excellent in shape freezability having a composition containing, by wt %, C: 0.01 to 0.2%, Si: 2.0% or less, Mn: 3.0% or less, P: 0.5% or less, Ti: 0.03 to 0.2%, and Al: 0.10% or less and comprising a balance of Fe and unavoidable impurities and having ferrite as main phases and comprised of main phases and second phase grains, in which hot rolled steel sheet, the average grain size of the ferrite is less than 4 μm, the second phase grains contain one or more of pearlite, martensite, bainite, and residual austenite, a coefficient of work hardening C of the stress-strain curve shown by the following formula (1) is 0.17 or less, and a yield elongation YEL is 1.5% or less.

$$\sigma—A\times(\varepsilon+B)^c \quad (1)$$

σ: true stress (MPa), ε: true strain, A, B: constants, C: coefficient of work hardening Further, PTL 3 proposes a method for producing fine grain high tensile steel comprising rolling a steel slab containing, by mass %, C: 0.03 to 0.9%, Si: 0.01 to 1.0%, Mn: 0.01 to 5.0%, Al: 0.001 to 0.5%, N: 0.001 to 0.1%, Nb: 0.003 to 0.5%, and Ti: 0.003 to 0.5%, having a balance of Fe and unavoidable impurities, and satisfying C %+(12/14)N %≥(12/48)Ti %+(12/48)Nb %+0.03% as cast or cooling it once to 500° C. to room temperature without rolling, then heating it to the $Ac_3$ point −100° C. to less than the $Ac_3$ point in temperature and rolling it or cooling it 500° C. to room temperature in temperature by a cooling rate of 0.1 to 50° C./sec without rolling, again heating it to 700° C. or less and 550° C. or more in temperature, and hot rolling it at 700° C. or less and 550° C. or more in temperature, during which making the rolling reduction per pass 20% or more and making one pass or the time between passes within 10 seconds in two or more consecutive working operations under conditions giving a strain rate of 1 to 200/sec and a total strain amount of 0.8 or more and 5 or less, then allowing it to cool. In the examples of PTL 3, it is specifically shown that by this method, the grain size of the ferrite is refined to as small as 0.6 μm.

CITATIONS LIST

Patent Literature

[PTL 1] Japanese Patent No. 3242303

[PTL 2] Japanese Unexamined Patent Publication No. 2000-290750

[PTL 3] Japanese Patent No. 4006112

SUMMARY

Technical Problem

Increasing the strength of a material generally causes the stretch flangeability and shape freezability and other material properties to deteriorate, so increasing the strength without causing these material properties to deteriorate becomes important in developing high strength hot rolled steel sheet.

However, in the high tensile hot rolled steel sheet described in PTL 1, the microstructure was a composite microstructure of ferrite and residual austenite. There were the problem that the stretch flangeability was low due to the difference in hardness among the structures and the problem that since ferrite comprised the main phases, the yield point elongation was large and the shape freezability was poor.

Further, in the hot rolled steel sheet described in PTL 2, the microstructure was comprised of ferrite and second phase grains (one or more of pearlite, martensite, bainite, and residual austenite), so there was the problem that the stretch flangeability was low due to the difference in hardness among the structures.

Further, in the method for producing high tensile steel described in PTL 3, interposition of a cooling process before rolling is liable to promote precipitation of carbides etc. Even in the subsequent reheating process, the temperature is a relatively low one of the $Ac_3$ point −100° C. to less than the $Ac_3$ point. If such precipitates are formed, they are hard to dissolve. In the finally obtained microstructure, the coarse precipitates remain. As a result, sometimes it was not necessarily possible to achieve sufficiently high stretch flangeability.

The present invention has as its object to solve the problem in the above-mentioned prior art and provide hot rolled steel sheet with a tensile strength of 440 MPa or more which is excellent in stretch flangeability and shape freezability and a method for producing the same.

BRIEF DESCRIPTION OF THE DRAWINGS

FIG. 1 shows Table 2-1, which includes data related to Examples and Comparative Examples discussed herein.

FIG. 2 shows Table 2-2, which includes data related to Examples and Comparative Examples discussed herein.

SOLUTION TO PROBLEM

To achieve the above-mentioned object, the inventors researched in depth techniques for refining the grains and for reducing the difference in hardness between ferrite and the balance microstructure in hot rolled steel sheet and furthermore improvement of the shape freezability. As a result, they discovered that even in dual phase structure steel with a large difference in hardness between structures such as with ferrite and bainite, if the average orientation difference of the ferrite in the same grain is large, the stretch flangeability is improved. Further, they discovered that by optimizing the rolling temperature, strain rate, time between passes, and total strain amount in the production process of hot rolled steel sheet, it is possible to cause ferrite transformation during rolling and refine the ferrite to an average grain size of 5.0 μm or less. Further, they discovered that high density dislocations are introduced into the ferrite produced in this way, so dislocation strengthening occurs and that the average orientation difference of ferrite in the same grains is also large, so even in a dual phase structure steel of ferrite and bainite etc., it becomes possible to obtain high stretch flangeability. Furthermore, since high density dislocations are introduced into the ferrite, the yield point elongation is small and the shape freezability is excellent.

The present invention was completed by further study based on these discoveries. That is, the gist of the present invention is as follows:

[1] A hot rolled steel sheet comprising a composition comprising, by mass %,

C: 0.01% or more and 0.20% or less,

Si: 1.0% or less,

Mn: 3.0% or less,

P: 0.040% or less,

S: 0.004% or less,

Al: 0.10% or less,

N: 0.004% or less, and a balance of Fe and impurities, wherein the hot rolled steel sheet comprises first ferrite with an average orientation difference in the same grain of 0.5° or more and 5.0° or less in 30 vol % or more and 70 vol % or less, at least one type of structures among bainite and second ferrite with an average orientation difference in the same grain of 0° or more and less than 0.5° and the first ferrite in a total of 95 vol % or more, and a balance microstructure of 5 vol % or less, and the hot rolled steel sheet has an average grain size of the first ferrite of 0.5 μm or more and 5.0 μm or less, has an average grain size of the at least one type of structures of 1.0 μm or more and 10 μm or less, and, when there is the balance microstructure, has an average grain size of the balance microstructure of 1.0 μm or more and 10 μm or less.

[2] The hot rolled steel sheet according to [1], further comprising, by mass %, one or more selected from Nb: 0.01% or more and 0.20% or less, Ti: 0.01% or more and 0.15% or less, Mo: 0.01% or more and 1.0% or less, Cu: 0.01% or more and 0.5% or less, and Ni: 0.01% or more and 0.5% or less.

[3] A method for producing a hot rolled steel sheet comprising:

(a) hot rolling a steel stock comprising the composition according to [1] or [2] without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 sec, and a total strain amount of all of the passes satisfying the conditions is 1.4 or more and 4.0 or less, (b) cooling the finishing rolled steel sheet by a 20° C./sec or more and 50° C./sec or less average cooling rate, wherein the cooling is started within 10 seconds after the hot rolling, and (c) coiling the steel sheet at 300° C. or more and 600° C. or less in temperature range, where, the A point is a temperature found by the following (formula 1) and the $Ae_3$ point is a temperature found by the following (formula 2):

$$A(^\circ C.)=910-310C-80Mn-20Cu-55Ni-80Mo \quad \text{(formula 1)}$$

$$Ae_3(^\circ C.)=919-266C+38Si-28Mn-27Ni+12Mo \quad \text{(formula 2)}$$

where, C, Si, Mn, Cu, Ni, and Mo are the contents (mass %) of the elements.

Advantageous Effects of Invention

According to the present invention, it is possible to obtain hot rolled steel sheet high in strength and excellent in stretch flangeability and shape freezability. If applying the present invention to the structural parts of automobiles etc., it is possible to obtain the high structure for securing the safety of the automobiles without lowering the press formability and other aspects of workability.

DESCRIPTION OF EMBODIMENTS

<Hot Rolled Steel Sheet>

The hot rolled steel sheet of the present invention has a predetermined composition, contains first ferrite with an average orientation difference in the same grain of 0.5° or more and 5.0° or less in 30 vol % or more and 70 vol % or less, contains at least one type of structures among bainite and second ferrite with an average orientation difference in the same grain of 0° or more and less than 0.5° and the first ferrite in a total of 95 vol % or more, has a balance microstructure of 5 vol % or less, has an average grain size of the first ferrite of 0.5 μm or more and 5.0 μm or less, has an average grain size of the at least one type of structures of 1.0 μm or more and 10 μm or less, and, when having a balance microstructure, has an average grain size of the balance microstructure of 1.0 μm or more and 10 μm or less.

Below, the hot rolled steel sheet of the present invention will be explained specifically. First, the reasons for limiting the chemical constituents (composition) of the hot rolled steel sheet of the present invention will be explained. Note that the "%" expressing the chemical constituents below all mean "mass %".

[C: 0.01% or More and 0.20% or Less]

C is used as a solution strengthening element for obtaining the desired strength. For this, at the least, 0.01% or more is necessary. The content of C may also be 0.02% or more, 0.04% or more, or 0.05% or more. On the other hand, more than 0.20% of C causes the workability and weldability to deteriorate. Therefore, the content of C is 0.20% or less. The content of C may also be 0.18% or less, 0.16% or less, or 0.15% or less.

[Si: 1.0% or Less]

Si is an element which keeps coarse oxides or cementite causing deterioration of the toughness from forming and also contributes to solution strengthening, but if the content is more than 1.0%, the hot rolled steel sheet remarkably deteriorates in surface properties and a drop in chemical convertability and corrosion resistance is invited. Therefore, the content of Si is 1.0% or less. Preferably, it is 0.9% or less or 0.8% or less. The content of Si may also be 0%. For example, it may be 0.01% or more, 0.02% or more, or 0.4% or more.

[Mn: 3.0% or Less]

Mn is an element which forms a solid solution to contribute to increasing the strength of the steel. On the other hand, if Mn is more than 3.0%, not only does the effect become saturated, but also segregated solidification causes formation of band-shaped structures and causes deterioration of the workability and delayed fracture resistance. Therefore, the content of Mn is 3.0% or less. Preferably, it is 2.8% or less or 2.0% or less. The content of Mn may also be 0%. For example, it may be 0.5% or more, 1.0% or more, or 1.4% or more.

[P: 0.040% or Less]

P is an element forming a solid solution to contribute to increase of strength of the steel, but is an element which segregates at the grain boundaries, in particular the prior austenite grain boundaries, and invites a decline in the low temperature toughness and workability. Therefore, the content of P is preferably reduced as much as possible, but a content of up to 0.040% is allowable. Therefore, the content of P is 0.040% or less. Preferably, it is 0.030% or less, more preferably 0.020% or less. The content of P may also be 0%, but even if greatly reducing it, an effect commensurate with the increase in the refining costs cannot be obtained, so preferably the content is 0.001%, 0.002% or more, 0.003% or more, or 0.005% or more.

[S: 0.004% or Less]

S bonds with Mn to form coarse sulfides and causes a drop in the workability of the hot rolled steel sheet. For this reason, the content of S is preferably reduced as much as possible, but containing it up to 0.004% is allowable. Therefore, the content of S is 0.004% or less. Preferably, it is 0.003% or less, more preferably 0.002% or less. The content of S may also be 0%, but even if greatly reducing it, an effect commensurate with the increase in the refining costs cannot be obtained, so preferably the content is 0.0003% or more, 0.0005% or more, or 0.001% or more.

[Al: 0.10% or Less]

Al is an element which acts as a deoxidizer and is effective for improving the cleanliness of the steel. However, excessive addition of Al invites an increase in oxide-based inclusions, causes a drop in toughness of the hot rolled steel sheet, and causes formation of flaws. Therefore, the content of Al is 0.10% or less. Preferably it is 0.09% or less, more preferably 0.08% or less. The content of Al may also be 0%, but even if greatly reducing it, an effect commensurate with the increase in the refining costs cannot be obtained, so preferably the content is 0.005% or more, 0.008% or more, or 0.01% or more.

[N: 0.004% or Less]

N bonds with nitride-forming elements to thereby precipitate as nitrides and contribute to refinement of the grains. However, if more than 0.004%, it becomes present as solid solution N and causes a drop in the toughness. Therefore, the content of N is 0.004% or less. Preferably, it is 0.003% or less. The content of N may also be 0%, but even if greatly reducing it, an effect commensurate with the increase in the refining costs cannot be obtained, so preferably the content is 0.0005% or more, 0.0008% or more, or 0.001% or more.

The above were the basic constituents of the hot rolled steel sheet of the present invention, but the hot rolled steel sheet of the present invention may, if necessary for the purpose of for example improving the toughness, increasing the strength, etc., further contain one or more selected from Nb: 0.01% or more and 0.20% or less, Ti: 0.01% or more and 0.15% or less, Mo: 0.01% or more and 1.0% or less, Cu: 0.01% or more and 0.5% or less, and Ni: 0.01% or more and 0.5% or less.

[Nb: 0.01% or More and 0.20% or Less]

Nb is an element which contributes to increase of the strength and fatigue strength of the steel sheet through formation of carbonitrides. To cause such an effect to be manifested, the content of Nb has to be 0.01% or more. For example, the content of Nb may be 0.02% or more or 0.03% or more. On the other hand, if the content of Nb is more than 0.20%, the deformation resistance increases, so the rolling load in the hot rolling at the time of production of hot rolled steel sheet increases, the load on the rolling machines becomes too great, and the rolling operation itself is liable to become difficult. Further, if the content of Nb is more than 0.20%, coarse precipitates are formed and the hot rolled steel sheet tends to fall in toughness. Therefore, the content of Nb is 0.20% or less. For example, the content of Nb is 0.15% or less or 0.10% or less.

[Ti: 0.01% or More and 0.15% or Less]

Ti forms fine carbonitrides to refine the grains and thereby improve the strength and fatigue strength of the steel sheet. To cause such an effect to be manifested, the content of Ti has to be 0.01% or more. For example, the content of Ti may be 0.02% or more, 0.04% or more, or more than 0.05%. On the other hand, if the content of Ti becomes excessive at more than 0.15%, the above-mentioned effect becomes saturated and further an increase in coarse precipitates is invited and a drop in toughness of the steel sheet is invited. Therefore, the content of Ti is 0.15% or less. Preferably it is 0.14% or less or 0.10% or less.

[Mo: 0.01% or More and 1.0% or Less]

Mo is an element contributing to higher strength of the steel sheet as a solid solution element. To obtain such an effect, the content of Mo has to be 0.01% or more. For example, the content of Mo may be 0.02% or more or 0.03% or more. However, Mo is high in alloy cost and, if more than 1.0%, causes the weldability to deteriorate. Therefore, the content of Mo is 1.0% or less. Preferably it is 0.5% or less or 0.4% or less.

[Cu: 0.01% or More and 0.5% or Less]

Cu is an element which forms a solid solution to contribute to increase of strength of the steel. To obtain this effect, the content of Cu has to be 0.01% or more. For example, the content of Cu may be 0.05% or more or 0.1% or more. However, if the content of Cu is more than 0.5%, a drop in the surface properties of the hot rolled steel sheet is invited. Therefore, the content of Cu is 0.5% or less. Preferably, it is 0.4% or less or 0.3% or less.

[Ni: 0.01% or More and 0.5% or Less]

Ni is an element which forms a solid solution to contribute to increase of strength of the steel and, further, improves the toughness. To obtain these effects, the content of Ni has to be 0.01% or more. For example, the content of Ni may be 0.02% or more or 0.1% or more. However, Ni is high in alloy cost and, if more than 0.5%, causes the weldability to deteriorate. Therefore, the content of Ni is 0.5% or less. Preferably, it is 0.4% or less or 0.3% or less.

Other elements may also be included within a range not interfering with the effect of the present invention. That is, the balance may be substantially iron. For example, for the purpose of improving the delayed fracture resistance, Ca, REMs (rare earth metals), etc. may be included in respective amounts of 0.005% or less. Trace elements etc. improving the hot workability may also be included.

In the hot rolled steel sheet of the present invention, the balance other than the above constituents is comprised of Fe and impurities. Here, "impurities" mean constituents which are mixed in due to various factors in the process of production such as raw materials like metal or scrap when industrially producing hot rolled steel sheet and encompass all constituents not intentionally added to the hot rolled steel sheet of the present invention. Further, "impurities" also encompass elements which are other than the constituents explained above and which are included in the hot rolled steel sheet at a level where the actions and effects distinctive to those elements do not affect the characteristics of the hot rolled steel sheet according to the present invention.

Next, the reasons for limiting the microstructure of the hot rolled steel sheet according to the present invention will be explained.

[First Ferrite with an Average Orientation Difference in the Same Grain of 0.5° or More and 5.0° or Less: 30 Vol % or More and 70 Vol % or Less]

The microstructure of the hot rolled steel sheet of the present invention includes first ferrite with an average orientation difference in the same grain of 0.5° or more and 5.0° or less of 30 vol % or more and 70 vol % or less.

Here, in the present invention, "the average orientation difference in the same grain" is an indicator expressing the disorder in crystals present in a certain single grain when defining something with an orientation difference from adjacent grains of 15° or more as a single grain. In the ferrite produced by usual ferrite transformation, the average orientation difference in the same grain is almost always 0.0°. On the other hand, if ferrite transformation occurs during rolling like in the present invention, the ferrite is also worked, so disorder in crystals occurs in the ferrite grains and the average orientation difference in the same grain becomes larger. To reduce the difference in hardness from bainite and reduce the yield point elongation, the average orientation difference in the same grain has to be 0.5° or more. On the other hand, if the average orientation difference in the same grain is more than 5.0°, the ductility of the ferrite deteriorates. Therefore, the average orientation difference in the same grain is 0.5° or more and 5.0° or less. More preferably it is 0.7° or more and 3.0° or less.

In the hot rolled steel sheet according to the present invention, if the first ferrite becomes less than 30 vol %, the volume rate of austenite at the stage of the end of the finishing rolling becomes greater than 70% and the fractions of the bainite formed in the subsequent cooling step and the second ferrite with an average orientation difference in the same grain of less than 0.5° increase, so the yield point elongation increases and the shape freezability falls. Accordingly, the volume rate of the first ferrite is 30 vol % or more. Further, to increase the volume ratio of the first ferrite, the rolling reduction at the time of hot rolling has to be raised or the temperature at the time of hot rolling has to be lowered, but if made conditional on being more than 70 vol %, the average orientation difference in the same grain will become more than 5.0° and the ferrite is liable to deteriorate in ductility and the stretch flangeability is liable to fall. Therefore, the volume rate of the first ferrite is 30 vol % or more and 70 vol % or less. Preferably, it is 35 vol % or more or 40 vol % or more or 50 vol % or more and/or 65 vol % or less or 60 vol % or less.

[At Least One Type of Structure Among Bainite and Second Ferrite with an Average Orientation Difference in the Same Grain of 0° or More and Less than 0.5° and the First Ferrite in Total 95 Vol % or More and Balance Microstructure in 5 Vol % or Less]

The hot rolled steel sheet according to the present invention contains at least one type of structures among bainite and second ferrite with an average orientation difference in the same grain of 0° or more and less than 0.5° and the first ferrite in a total of 95 vol % or more, preferably 98 vol % or more or 100 vol %. The balance microstructure is not particularly limited, but for example the sheet contains one or both of martensite and residual austenite or is comprised of one or both of martensite and residual austenite. If the balance microstructure becomes greater than 5 vol %, the drop in the stretch flangeability due to the difference in hardness between the structures of the balance microstructure and the second ferrite or bainite becomes remarkable and it becomes difficult to obtain the desired stretch flangeability and/or in particular if the volume rate of the martensite of the balance microstructure becomes higher, the yield ratio becomes higher and the shape freezability falls. Therefore, the balance microstructure is 5 vol % or less. More preferably it is 2% or less. It may also be 0 vol %.

[Average Grain Size of First Ferrite: 0.5 μm or More and 5.0 μm or Less]

In the present invention, the "average grain size" is the value calculated when defining something with a difference of orientation from the adjacent grains of 15° or more as a single crystal grain. If the average grain size of the first ferrite is more than 5.0 μm, the desired strength becomes difficult to obtain or the toughness deteriorates, so the average grain size has to be 5.0 μm or less. On the other hand, to make the average grain size smaller than 0.5 μm, large strain working becomes necessary at the time of rolling, a large load acts on the rolling machines, and the possibility of the average orientation difference in the same grain becoming more than 5.0° becomes higher. For this reason, the average grain size is made 0.5 μm or more. Therefore, the average grain size of the first ferrite is 0.5 μm or more and 5.0 μm or less, preferably 0.7 μm or more or 1.0 μm or more, and/or 4.5 μm or less or 4.0 μm or less.

[Average Grain Size of at Least One Type of Structures Among Bainite and Second Ferrite and Balance Microstructure: 1.0 μm or More and 10 μm or Less]

If the average grain size of the bainite, second ferrite, and any existing balance microstructure becomes greater than 10 μm, the strength falls, the yield point elongation increases, and the shape freezability deteriorates. Therefore, the average grain size of these structures is 10 μm or less. However, in particular, if bainite is refined to 1.0 μm or less, the strength remarkably increases, the difference in hardness with the first ferrite becomes greater, and the stretch flangeability is liable to fall. Therefore, the average grain size of these structures is 1.0 μm or more. Preferably it is 1.5 μm or more or 2.0 μm or more and/or 9.0 μm or less, 8.0 μm or less, or 5.0 μm or less.

In the hot rolled steel sheet according to the present invention, the phases or the structures can be identified and the average grain size can be calculated by image processing using a structural photograph taken by a scan electron microscope or electron back scatter analysis (EBSP or EBSD).

More specifically, the volume rate of the first ferrite is determined as follows. When designating the width of the steel sheet as W, a sample is taken at a position of ¼W (width) or ¾W (width) from one end in the width direction of the steel sheet so that the cross-section (cross-section in width direction) of the width direction of the steel sheet seen from the rolling direction becomes the observed surface. Rectangular regions of width direction 200 μm×thickness direction 100 μm of the steel sheet at ¼ depth position of sheet thickness from the surface of the steel sheet are analyzed by EBSD at 0.2 μm measurement intervals. Here, the EBSD analysis is, for example, performed using an apparatus comprised of a thermal field emission type scan electron microscope and an EBSD detector at an analysis speed of 200 to 300 points/sec. Here, the orientation difference is the difference in crystal orientations between adjacent measurement points found based on crystal orientation information of measurement points measured by the above. When this orientation difference is 15° or more, the boundary between adjacent measurement points is judged to be a grain boundary and the region surrounded by that grain boundary is defined as a grain in the present invention. A simple average is found of the orientation difference in the same grain of that grain to calculate the average orientation difference. Further, the area rate of the grains of the first ferrite is found. This is made the volume rate of the first ferrite. Further, the volume rate of the second ferrite may also be similarly determined. Note that, the average orientation difference in the same grain can be found using software attached to the EBSD analysis apparatus. Further, bainite may also have an average orientation difference in the same grain of 0.5° or more, but bainite is shaped exhibiting a lath-like microstructure, so something including carbides and having a lath-like structure in an SEM image is deemed bainite. The area rate is made the volume rate of the bainite.

The average grain sizes of the "first ferrite with an average orientation difference in the same grain of 0.5° or more and 5.0° or less", the "second ferrite with an average orientation difference in the same grain of 0° or more and less than 0.5°", "bainite", and "balance microstructure" are determined using values found by the above EBSD analysis. Specifically, the value calculated by the following formula when defining a boundary with an orientation difference of 15° or more as a grain boundary is defined as the average grain size. In the formula, N is the number of grains included in a region for evaluation of the average grain size, Ai is the area of the i-th (i=1, . . . , N) grain, and di is the circle equivalent diameter of the i-th grain. These data are easily found by EBSD analysis.

[Mathematical 1]

$$D = \frac{\sum_{i=1}^{N} Ai \times di}{\sum_{i=1}^{N} Ai}$$

According to the present invention, by satisfying the above chemical constituents (composition) and microstructure, it is possible to obtain hot rolled steel sheet high in strength and excellent in stretch flangeability and shape freezability. Therefore, when applying the hot rolled steel sheet according to the present invention to a structural part of an automobile etc., it is possible to obtain the high strength required for securing safety in the automobile without deterioration of the press formability or other workability.

<Method for Producing Hot Rolled Steel Sheet>

Next, the method for producing the hot rolled steel sheet according to the present invention will be explained.

The method for producing the hot rolled steel sheet according to the present invention comprises (a) hot rolling a steel stock comprising the chemical constituents (composition) explained above without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 seconds, and a total strain amount of all of the passes satisfying the conditions is 1.4 or more and 4.0 or less, (b) cooling the finishing rolled steel sheet by a 20° C./sec or more and 50° C./sec or less average cooling rate, wherein the cooling is started within 10 seconds after the hot rolling, and (c) coiling the steel sheet at 300° C. or more and 600° C. or less in temperature range, where, the A point is a temperature found by the following (formula 1) and the $Ae_3$ point is a temperature found by the following (formula 2):

$$A(°\,C.)=910-310C-80Mn-20Cu-55Ni-80Mo \quad \text{(formula 1)}$$

$$Ae_3(°\,C.)=919-266C+38Si-28Mn-27Ni+12Mo \quad \text{(formula 2)}$$

where, C, Si, Mn, Cu, Ni, and Mo are the contents (mass %) of the elements.

Below, the method of production of the present invention will be explained in detail.

[(a) Hot Rolling]

The hot rolling includes finishing rolling by continuously running a cast steel stock having the chemical composition (constituents) explained above through a plurality of rolling stands. Further, descaling may be performed before the finishing rolling or in the middle of rolling between rolling stands in the finishing rolling. In the method of the present invention, the finishing rolling, as explained later, is performed by a low strain rate so as to cause ferrite transformation during the rolling. Therefore, the finishing rolling is preferably performed by direct rolling connecting continuous casting and finishing rolling where such rolling at a low strain rate is easily performed. However, the technique of reheating-roughing rolling-finishing rolling a slab of the general hot rolling method may also be adopted. In that case, the slab heating temperature is 1100° C. or more for homogenizing the slab and is 1350° C. or less for preventing coarsening of the austenite grain size. Further, the method for producing the steel stock is not limited to any specific method. Any commonly used method refining molten steel having the above-mentioned chemical constituents in a converter etc. and casting it into a slab or other steel stock by continuous casting or other casting method can be applied.

(Rolling Temperature at all Rolling Stands of Finishing Rolling: A Point or More)

In the method of the present invention, the finishing rolling is performed by continuously running the as-cast steel stock, that is, the steel stock right after casting, or a heated steel stock through a plurality of rolling stands. The rolling temperature in all of the rolling stands of the finishing rolling is the A point found by the following (formula 1) or more.

$$A(°\,C.)=910-310C-80Mn-20Cu-55Ni-80Mo \quad \text{(formula 1)}$$

where, C, Mn, Cu, Ni, and Mo are the contents of the elements (mass %).

If becoming less than the A point, in addition to the ferrite transformation during rolling, ferrite transformation occurs accompanying the lower temperature. The ferrite formed by the latter ferrite transformation is large in grain size and invites a drop in tensile strength and toughness. Further, due to the formation of such ferrite, control of the makeup of the microstructure also becomes difficult. Therefore, the temperature at all of the rolling stands has to be the A point or more. For example, the temperature at all of the rolling stands may be 1100° C. or less.

(Rolling Temperature of Two or More Consecutive Passes of Rolling Including Final Pass of Finishing Rolling: A Point or More and Less than $Ae_3$ Point)

If this rolling temperature becomes the $Ae_3$ point found by the following (formula 2) or more, it becomes difficult to cause ferrite transformation during rolling, so the temperature is less than the $Ae_3$ point.

$$Ae_3(^\circ C.)=919-266C+38Si-28Mn-27Ni+12Mo \quad \text{(formula 2)}$$

where, C, Si, Mn, Ni, and Mo are the contents of the elements (mass %).

Further, if becoming less than the A point, in addition to the ferrite transformation during rolling, ferrite transformation occurs accompanying the lower temperature. The ferrite formed by the latter ferrite transformation is large in grain size and invites a drop in tensile strength and toughness. Further, due to the formation of such ferrite, control of the makeup of the microstructure also becomes difficult. Therefore, the rolling temperature of two or more consecutive passes of rolling including the final pass of finishing rolling is the A point or more and less than the $Ae_3$ point.

(Strain Rate of Two or More Consecutive Passes of Rolling Including Final Pass of Finishing Rolling: 1.0 to 50/Sec)

To cause ferrite transformation during rolling, the strain rate is preferably a low rate. If the strain rate is more than 50/sec, the rolling reduction required for causing ferrite transformation becomes greater and the load on the rolling machine increases. Further, the heat generated by the work becomes greater and the possibility of the rolling temperature becoming the $Ae_3$ point or more becomes higher. Therefore, the strain rate is 50/sec or less. Further, if the strain rate is less than 1.0/sec, the effect of the heat removal by the rolls of the rolling machined becomes greater and the possibility of the rolling temperature becoming less than the A point becomes higher. Therefore, the strain rate is 1.0/sec or more and 50/sec or less. More preferably it is 1.5/sec or more and 30/sec or less.

(Time Between Passes of Two or More Consecutive Passes of Rolling Including Final Pass of Finishing Rolling: Within 10 Seconds)

The time between passes affects the recovery of strain between the rolling stands and the recrystallization behavior. If the time between passes is more than 10 seconds, recovery of strain between stands and recrystallization occur and the strain stored in the preceding rolling passes ends up being released, so causing ferrite transformation during rolling becomes difficult. Therefore, the time between passes is within 10 seconds. Preferably it is within 8.5 seconds, within 7 seconds, or within 5 seconds. For example, the time between passes may be 1 second or more.

(Total Strain Amount: 1.4 or More and 4.0 or Less)

The total strain amount of all of the passes where the two or more consecutive passes of rolling including the final pass of the above finishing rolling satisfy the conditions of the rolling temperature: A point or more and less than $Ae_3$ point, strain rate: 1.0 to 50/sec, and time between passes: within 10 seconds is 1.4 or more and 4.0 or less. This total strain amount has a great effect on the amount of ferrite transformation during rolling and refinement of the balance bainite and ferrite. If the total strain amount is less than 1.4, a sufficient amount of ferrite transformation is difficult to cause. Further, the balance bainite and ferrite become coarser in grain size. On the other hand, if the total strain amount is more than 4.0, the average orientation difference in the same grain of the ferrite formed during rolling becomes more than 5.0 and the ferrite deteriorates in ductility. Therefore, the total strain amount is 1.4 or more and 4.0 or less. Preferably it is 1.6 or more and 3.5 or less.

If the above rolling conditions do not continue, ferrite transformation can no longer be caused during rolling and/or the ferrite formed during rolling transforms back to austenite resulting in the first ferrite fraction of the final microstructure becoming falling and the shape freezability of the obtained hot rolled steel sheet deteriorating. Further, if the final pass does not satisfy the rolling conditions, transformation of ferrite back to austenite occurs in the final pass and the first ferrite fraction in the final microstructure decreases or the ferrite recovers, so the yield point elongation becomes greater and the shape freezability deteriorates. Alternatively, further, if the rolling temperature of the final pass becomes less than the A point, in addition to the ferrite transformation during rolling, ferrite transformation occurs accompanying the lower temperature. The ferrite formed by the latter ferrite transformation is large in grain size and a drop in the tensile strength is invited. Therefore, the two or more consecutive passes of rolling including the final pass of the above finishing rolling must be performed under the conditions of the rolling temperature: A point or more and less than $Ae_3$ point, strain rate: 1.0 to 50/sec, and time between passes: within 10 seconds and so that the total strain amount of all of the passes satisfying the conditions becomes 1.4 or more and 4.0 or less.

(Roughing Rolling)

In the method of the present invention, for example, for adjusting the sheet thickness etc., the steel stock may be roughing rolled before the finishing rolling. The roughing rolling need only secure the desired sheet bar dimensions. The conditions are not particularly limited.

[(b) Cooling]

According to the method of the present invention, the finishing rolled steel sheet is cooled in the cooling step by a 20° C./sec or more and 50° C./sec or less average cooling rate. The cooling is started within 10 seconds after the above hot rolling. If more than 10 seconds from the end of the hot rolling to the start of cooling, the ferrite recovers, the yield point elongation becomes greater, and the obtained hot rolled steel sheet falls in shape freezability. Preferably, the cooling is started within 9 seconds or within 8 seconds after the hot rolling. Further, if the average cooling rate is less than 20° C./sec, the strain in the ferrite formed during rolling recovers causing softening, the yield point elongation becomes greater, and the shape freezability deteriorates. Further, if the cooling rate is more than 50° C./sec, martensite easily forms. Therefore, the average cooling rate after the hot rolling is 20° C./sec or more and 50° C./sec or less. Preferably it is 30° C./sec or more and 45° C./sec or less.

[(c) Coiling]

The steel sheet cooled down to the above cooling stop temperature in the above cooling is coiled up in the coiling step at 300° C. or more and 600° C. or less in temperature range. The steel sheet is coiled right after the cooling, so the coiling temperature is substantially equal to the cooling stop temperature. If the coiling temperature becomes more than 600° C., recovery occurs in the first ferrite, the strength falls, the yield point elongation increases, and the shape freezability falls. Further, if less than 300° C., martensite is formed, the yield ratio increases, and the shape freezability falls. Therefore, the coiling temperature which becomes the cooling stop temperature is 300° C. or more and 600° C. or less. For example, the coiling temperature may be 320° C. or more or 350° C. or more and/or may be 580° C. or less or 550° C. or less.

Note that, after coiling, the hot rolled steel sheet may be skin-pass rolled in accordance with an ordinary method. Further, it may be pickled to remove the scale formed on its surface. Alternatively, further, it may be hot dip galvanized, electrogalvanized, or otherwise plated or chemically converted.

By casting steel stock having the same composition as that explained for the hot rolled steel sheet of the present invention, then, as explained above, hot rolling it, then cooling and coiling it, it is possible to reliably produce hot rolled steel sheet containing the first ferrite in 30 vol % or more and 70 vol % or less, containing at least one type of structures among bainite and the second ferrite and the first ferrite in a total of 95 vol % or more, having a balance microstructure of 5 vol % or less, having an average grain size of the first ferrite of 0.5 μm or more and 5.0 μm or less, having an average grain size of the at least one type of structures of 1.0 μm or more and 10 μm or less, and, when there is the balance microstructure, having an average grain size of the balance microstructure of 1.0 μm or more and 10 μm or less. For this reason, according to the above method of production, it is possible to provide hot rolled steel sheet with a tensile strength of 440 MPa or more excellent in stretch flangeability and shape freezability.

Below, examples will be used to explain the present invention in further detail, but the present invention is not limited to these examples in any way.

EXAMPLES

Molten steels of the chemical compositions shown in Table 1 were refined in a converter. Next, these steel stocks were hot rolled, cooled, and coiled under the conditions shown in Table 2 to manufacture thickness 3.0 mm hot rolled steel sheets. The balances other than the constituents shown in Table 1 consisted of Fe and impurities. Further, samples taken from the manufactured hot rolled steel sheets were analyzed. The chemical compositions were equivalent to the chemical compositions of the steels shown in Table 1.

[Table 1]

TABLE 1

| Steel | Chemical composition (mass %) | | | | | | | | | | | | $Ae_3$ | A | |
|---|---|---|---|---|---|---|---|---|---|---|---|---|---|---|---|
| type | C | Si | Mn | P | S | Al | N | Ti | Nb | Mo | Cu | Ni | ° C. | ° C. | Remarks |
| A | 0.08 | 0.8 | 2.0 | 0.004 | 0.002 | 0.06 | 0.004 | | | | | | 872 | 725 | Newly developed steel |
| B | 0.05 | 0.02 | 2.1 | 0.003 | 0.002 | 0.01 | 0.004 | 0.10 | | | | | 848 | 727 | Newly developed steel |
| C | 0.10 | 0.05 | 1.5 | 0.003 | 0.003 | 0.02 | 0.003 | | 0.04 | | | | 852 | 759 | Newly developed steel |
| D | 0.08 | 0.6 | 2.1 | 0.002 | 0.001 | 0.08 | 0.004 | 0.14 | 0.02 | | | | 862 | 717 | Newly developed steel |
| E | 0.10 | 0.2 | 2.8 | 0.010 | 0.003 | 0.07 | 0.004 | 0.10 | | 0.03 | | | 822 | 653 | Newly developed steel |
| F | 0.15 | 0.7 | 1.4 | 0.022 | 0.004 | 0.06 | 0.003 | | | | 0.2 | 0.4 | 856 | 726 | Newly developed steel |
| G | 0.11 | 0.03 | 1.6 | 0.007 | 0.003 | 0.09 | 0.003 | | | 0.2 | | 0.02 | 848 | 731 | Newly developed steel |
| H | **0.25** | 0.2 | 1.5 | 0.004 | 0.003 | 0.05 | 0.004 | 0.04 | 0.03 | | | | 818 | 713 | Comp. steel |
| I | 0.10 | 0.4 | **3.7** | 0.010 | 0.003 | 0.04 | 0.004 | | | | | | 804 | 583 | Comp. steel |

Bold underlines show outside scope of present invention.

Empty fields show corresponding elements not proactively included.

In Table 2, the "heating temperature" is the temperature in the case of reheating the slab. "Direct" shows performing finishing rolling by hot direct rolling connecting continuous casting and finishing rolling. Further, "F1" to "F7" show the rolling stands in the finishing rolling, the "rolling temperature" in each field shows the temperature at the entrance side of the stand, and the "time between passes" shows the time from right after exiting a stand to reaching the next stand. Further, "T" shows the time from after the hot rolling (after end of finishing rolling) to the start of cooling. Further, the cooling after finishing rolling was made water cooling and was performed by running the steel sheet through a water cooling facility not having air cooling sections. The cooling rate at the time of cooling is shown by the average rate obtained by dividing the amount of drop of temperature of the steel sheet from when being led into the water cooling facility to when being led out from the water cooling facility by the time required for the steel sheet to pass through the water cooling facility.

Test pieces were taken from the obtained hot rolled steel sheets and examined for microstructure (scan type electron microscope and EBSD) and subjected to tensile tests and hole expansion tests. The microstructures were observed using an apparatus comprised of a thermal field emission scan electron microscope (JSM-7001F made by JEOL) and an EBSD detector (HIKARI detector made by TSL) at an analysis speed of 200 to 300 points/sec. The average orientation difference in the same grain was found using software attached to the EBSD analysis apparatus (OIM Analysis™). Further, the hole expansion test was performed by punching a 10 mmφ hole in a test piece (initial hole: hole diameter d0=10 mm), turning the burr side up, using a conical punch with a top angle of 60 degrees to push against the initial hole until a crack passing through the sheet thickness occurred, measuring the hole diameter d1 mm when the crack occurred, and finding the hole expansion rate λ (%) by the following formula. The results of these are shown in Table 3.

$$\lambda=100\times(d1-d0)/d0$$

[Table 4]

TABLE 3

| | | Microstructure | | | | | | | | | | | | | |
|---|---|---|---|---|---|---|---|---|---|---|---|---|---|---|---|
| | | α1 phases | | B phases | | α2 phases | | α1 + B + α2 | Balance microstructure | | | | | | |
| No. | Steel type | Vol. rate % | Average grain size μm | Vol. rate % | Average grain size μm | Vol. rate % | Average grain size μm | Vol. rate % | Vol. rate % | Average grain size μm | Tensile strength MPa | Stretch flangeability λ % | Yield ratio % | Yield point elongation % | Remarks |
| 1 | A | 65 | 0.7 | 14 | 4.3 | 19 | 7.4 | 98 | 2 | 1.4 | 658 | 114 | 68 | 0.2 | Ex. 1 |
| 2 | A | 65 | 1.9 | 30 | 7.7 | 2 | 7.6 | 97 | 3 | 7.1 | 675 | 120 | 68 | 0 | Ex. 2 |
| 3 | A | 69 | 3.1 | 27 | 6.9 | 3 | 4.1 | 99 | 1 | 9.4 | 720 | 134 | 60 | 0 | Ex. 3 |
| 4 | A | **0** | — | 74 | 5.7 | 25 | 2.5 | 99 | 1 | 1.1 | 687 | 113 | 62 | **3.5** | Comp. Ex. 4 |
| 5 | A | **23** | 3 | 4 | 7.4 | 73 | 9.8 | 100 | 0 | — | **408** | 97 | 68 | **5.1** | Comp. Ex. 5 |
| 6 | B | 69 | 2.5 | 16 | 1.6 | 11 | 3.8 | 96 | 4 | 2.2 | 656 | 134 | 60 | 0.3 | Ex. 6 |
| 7 | B | 41 | 3.4 | 27 | 4.3 | 28 | 1.9 | 96 | 4 | 5.4 | 703 | 117 | 63 | 0.8 | Ex. 7 |
| 8 | B | 63 | 2.9 | 20 | 2.8 | 17 | 6.1 | 100 | 0 | — | 627 | 103 | 58 | 0.1 | Ex. 8 |
| 9 | B | 70 | 3.4 | 24 | 6.2 | 4 | 8.8 | 98 | 2 | 2 | 684 | 105 | 56 | 0 | Ex. 9 |
| 10 | B | 47 | 1.3 | 9 | 7.9 | 20 | 4.4 | **76** | **24** | 7.2 | 665 | 91 | **76** | 0.2 | Comp. Ex. 10 |
| 11 | C | 68 | 4.3 | 22 | 4.2 | 7 | 2.6 | 97 | 3 | 6.3 | 661 | 102 | 60 | 0.3 | Ex. 11 |
| 12 | C | 66 | 4.1 | 26 | 9.2 | 8 | 6.1 | 100 | 0 | — | 620 | 135 | 54 | 0.3 | Ex. 12 |
| 13 | C | **27** | 4.4 | 24 | 5.8 | 48 | 6.7 | 99 | 1 | 1.9 | 471 | 117 | 58 | **2.3** | Comp. Ex. 13 |
| 14 | C | 49 | 2.7 | 34 | 5.7 | 12 | 8.9 | 95 | 5 | 9.7 | 728 | 98 | 62 | 0.4 | Ex. 14 |
| 15 | C | 69 | 2.1 | 22 | 2.9 | 8 | 9.6 | 99 | 1 | 8 | 604 | 105 | 64 | 0.2 | Ex. 15 |
| 16 | D | **87** | **14.5** | 11 | 9.2 | 1 | 7.6 | 99 | 1 | 3.6 | **431** | 94 | 52 | 0 | Comp. Ex. 16 |
| 17 | D | 61 | 2.3 | 24 | 2.6 | 12 | 2.2 | 97 | 3 | 1.8 | 670 | 90 | 61 | 0.2 | Ex. 17 |
| 18 | D | 45 | 4.2 | 40 | 5.6 | 15 | 4.8 | 100 | 0 | 8 | 699 | 111 | 56 | 0.3 | Ex. 18 |
| 19 | E | 59 | 4.5 | 22 | 6 | 16 | 8.9 | 97 | 3 | 2.5 | 619 | 137 | 68 | 0.7 | Ex. 19 |
| 20 | E | 58 | 2.2 | 31 | 7.7 | 7 | 8.1 | 96 | 4 | 9.7 | 682 | 112 | 59 | 0.1 | Ex. 20 |
| 21 | E | 56 | 3.7 | 27 | 7.8 | 16 | 4.7 | 99 | 1 | 5.2 | 661 | 100 | 64 | 0.2 | Ex. 21 |
| 22 | F | 56 | 3.1 | 22 | 6.2 | 20 | 4.1 | 98 | 2 | 5 | 701 | 92 | 55 | 0.5 | Ex. 22 |
| 23 | F | **13** | 3.4 | 22 | 7.7 | 63 | 2 | 98 | 2 | 2.3 | **417** | 91 | 56 | **2.4** | Comp. Ex. 23 |
| 24 | F | 47 | 2.7 | 30 | 5.4 | 18 | 2.4 | 95 | 5 | 5.6 | 594 | 124 | 55 | 0.3 | Ex. 24 |
| 25 | G | 67 | 2.1 | 28 | 9.2 | 3 | 9.3 | 98 | 2 | 1.8 | 610 | 138 | 53 | 0 | Ex. 25 |
| 26 | G | 47 | 4 | 33 | 5.1 | 19 | 2.9 | 99 | 1 | 1.1 | 715 | 107 | 63 | 0.4 | Ex. 26 |
| 27 | G | 50 | 2.1 | 32 | 3.6 | 17 | 3.5 | 99 | 1 | 4.8 | 700 | 110 | 55 | 0.4 | Ex. 27 |
| 28 | G | **11** | 0.8 | 51 | 8.9 | 34 | **12.1** | 96 | 4 | 8.8 | 641 | 111 | 64 | **2.9** | Comp. Ex. 28 |
| 29 | H | 57 | 1.4 | 37 | 6.1 | 2 | 9.9 | 96 | 4 | 2.9 | 686 | **62** | 52 | 0.3 | Comp. Ex. 29 |
| 30 | I | 50 | 4.3 | 28 | 5.1 | 17 | 5.9 | 95 | 5 | 9.7 | 626 | **47** | 55 | 0.4 | Comp. Ex. 30 |

Bold underlines show outside scope of present invention.

In Table 3, the "α1 phases" indicate first ferrite with an average orientation difference in the same grain of 0.5° or more and 5.0° or less, the "B phases" indicate bainite, and the "α2 phases" indicate second ferrite with an average orientation difference in the same grain of less than 0.5°. Further, the "balance microstructure" included martensite and residual austenite. From Table 3, it is learned that the hot rolled steel sheets of the examples all have a tensile strength of 440 MPa or more and are excellent in stretch flangeability and shape freezability. Note that "excellent in stretch flangeability" referred to here means a λ of 90% or more while "excellent in shape freezability" means a yield ratio of 70% or less and a yield point elongation of less than 1.0%.

On the other hand, the hot rolled steel sheets of the comparative examples outside the scope of the present invention are inferior in tensile strength, stretch flangeability, and/or shape freezability. In Comparative Example 4, the rolling temperature of the final pass of the finishing rolling etc. is the $Ae_3$ point or more, so no ferrite transformation occurred during the rolling. As a result, the yield point elongation increased and the shape freezability deteriorated. In Comparative Example 5, the cooling rate is slower than 20° C./sec, recovery occurs in the al phases and the fraction of the α2 phases increases and as a result the strength falls, the yield point elongation increases, and the shape freezability deteriorates. In Comparative Example 10, the coiling temperature (cooling stop temperature) is less than 300° C., so the martensite fraction in the balance microstructure increases, that is, the balance microstructure increases to more than 5 vol %, and as a result the yield ratio becomes more than 70% and the shape freezability deteriorates. In Comparative Example 13, more than 10 seconds elapse from after the hot rolling (end of finishing rolling) to the start of cooling, recovery occurs in the α1 phases and the fraction of the α2 phases increases, the yield point elongation increases, and the shape freezability deteriorates.

In Comparative Example 16, during the finishing rolling, the rolling temperature becomes less than the A point. Ferrite is formed accompanying the drop in temperature during rolling, so the grain size of the al phases becomes larger to more than 5.0 μm and the tensile strength falls. In Comparative Example 23, the coiling temperature exceeds 600° C., recovery occurs in the α1 phases and the fraction of the α2 phases increases, the strength falls, the yield point elongation increases, and the shape freezability deteriorates. In Comparative Example 28, the total strain amount is less than 1.4, the volume rate of the al phases decreases to less than 30 vol %, and the yield point elongation increases, so the shape freezability deteriorates. Comparative Example 29 satisfies the conditions of hot rolling, cooling, and coiling, but the amount of C is large, so the amount of cementite in the microstructure becomes greater, the hole expandability falls, and the stretch flangeability deteriorates. Similarly, Comparative Example 30 satisfies the various conditions of hot rolling, cooling, and coiling, but the amount of Mn is large, so band structures are formed in the microstructure, the hole expandability falls, and the stretch flangeability deteriorates.

The invention claimed is:

1. A hot rolled steel sheet comprising a composition comprising, by mass %,

C: 0.01% or more and 0.20% or less,

Si: 1.0% or less,

Mn: 3.0% or less,

P: 0.040% or less,

S: 0.004% or less,

Al: 0.10% or less,

N: 0.004% or less, and a balance of Fe and impurities, wherein the hot rolled steel sheet comprises first ferrite with an average orientation difference in the same grain of 0.5° or more and 5.0° or less in 30 vol % or more and 70 vol % or less, at least one type of structures among bainite and second ferrite with an average orientation difference in the same grain of 0° or more and less than 0.5° and where the first ferrite and the at least one type of structures are present in a total of 95 vol % or more, and a balance microstructure of 5 vol % or less, and the hot rolled steel sheet has an average grain size of the first ferrite of 0.5 μm or more and 5.0 μm or less, has an average grain size of the at least one type of structures of 1.0 μm or more and 10 μm or less, and, when there is the balance microstructure, has an average grain size of the balance microstructure of 1.0 μm or more and 10 μm or less.

2. The hot rolled steel sheet according to claim 1, further comprising, by mass %, one or more selected from Nb: 0.01% or more and 0.20% or less, Ti: 0.01% or more and 0.15% or less, Mo: 0.01% or more and 1.0% or less, Cu: 0.01% or more and 0.5% or less, and Ni: 0.01% or more and 0.5% or less.

3. A method for producing a hot rolled steel sheet comprising:

(a) hot rolling a steel stock comprising the composition according to claim 1 without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 sec, and a total strain amount of all of the passes satisfying the conditions is 1.4 or more and 4.0 or less, (b) cooling the finishing rolled steel sheet by a 20° C./sec or more and 50° C./sec or less average cooling rate, wherein the cooling is started within 10 seconds after the hot rolling, and (c) coiling the steel sheet at 300° C. or more and 600° C. or less in temperature range, where, the A point is a temperature found by the following (formula 1) and the $Ae_3$ point is a temperature found by the following (formula 2):

$$A(^\circ C.)=910-310C-80Mn-20Cu-55Ni-80Mo \quad \text{(formula 1)}$$

$$Ae_3(^\circ C.)=919-266C+38Si-28Mn-27Ni+12Mo \quad \text{(formula 2)}$$

where, C, Si, Mn, Cu, Ni, and Mo are the contents (mass %) of the elements.

4. A method for producing a hot rolled steel sheet comprising:

(a) hot rolling a steel stock comprising the composition according to claim 2 without cooling after casting or hot rolling the cast steel stock after cooling once to room temperature, then heating to 1100° C. or more and 1350° C. or less, wherein the hot rolling includes finishing rolling by continuously running the cast steel stock through a plurality of rolling stands, a rolling temperature at all of the rolling stands of the finishing rolling is an A point or more, two or more consecutive passes of rolling including a final pass of the finishing rolling are performed under conditions of a rolling temperature: A point or more and less than $Ae_3$ point, a strain rate: 1.0 to 50/sec, and a time between passes: within 10 sec, and a total strain amount of all of the passes satisfying the conditions is 1.4 or more and 4.0 or less, (b) cooling the finishing rolled steel sheet by a 20° C./sec or more and 50° C./sec or less average cooling rate, wherein the cooling is started within 10 seconds after the hot rolling, and (c) coiling the steel sheet at 300° C. or more and 600° C. or less in temperature range, where, the A point is a temperature found by the following (formula 1) and the $Ae_3$ point is a temperature found by the following (formula 2):

$$A(^\circ C.)=910-310C-80Mn-20Cu-55Ni-80Mo \quad \text{(formula 1)}$$

$$Ae_3(^\circ C.)=919-266C+38Si-28Mn-27Ni+12Mo \quad \text{(formula 2)}$$

where, C, Si, Mn, Cu, Ni, and Mo are the contents (mass %) of the elements.

* * * * *